US005529253A

United States Patent [19]

Maillet et al.

[11] Patent Number: 5,529,253

[45] Date of Patent: Jun. 25, 1996

[54] SPRING CANISTER FOR PULVERIZER

[75] Inventors: Louis J. Maillet; Matthew R. Brown; Joe H. Bunton, all of Ft. Collins, Colo.

[73] Assignee: March-Southwestern Corp., Ft. Collins, Colo.

[21] Appl. No.: 416,961

[22] Filed: Apr. 5, 1995

[51] Int. Cl.[6] ..... B02C 15/00

[52] U.S. Cl. ..... 241/121; 241/289

[58] Field of Search ..... 241/121, 289, 241/122, 123

[56] References Cited

U.S. PATENT DOCUMENTS 4,432,500 9/1995 Brundiek et al. ..... 241/57

4,706,900 9/1995 Prairie et al. ..... 241/121

*Primary Examiner*—Mark Rosenbaum

*Assistant Examiner*—Khristian K. Gaines

*Attorney, Agent, or Firm*—Dean P. Edmundson

[57] ABSTRACT

A spring canister for use in a coal pulverizer to impart an axial load to a bracket assembly supporting a grinding wheel or roller. The axial load causes the bracket assembly to pivot downwardly to increase the grinding force between the wheel or roller and the grinding bowl.

5 Claims, 3 Drawing Sheets

SPRING CANISTER FOR PULVERIZER

FIELD OF THE INVENTION

This invention relates generally to pulverizers (e.g., coal pulverizers). More particularly, this invention relates to vertical spindle coal pulverizers. Even more particularly, this invention relates to apparatus for imparting additional force upon roll wheel or journal assemblies in a coal pulverizer.

BACKGROUND OF THE INVENTION

In coal pulverizers of the vertical spindle type, hardened grinding elements are used for the fine crushing of coal. The hardened grinding elements may vary in design, but all are intended to capture raw unground coal particles between two hardened surfaces. The grinding elements crush the raw coal particles in a bowl during normal mill operation.

In certain vertical spindle coal pulverizer designs, the grinding elements are each shaped similarly to a large diameter tire or wheel. This type of grinding element may be referred to as a roll wheel assembly. These roll wheel assemblies are common in certain types of vertical spindle coal pulverizers.

In other types of vertical spindle coal pulverizers, the grinding elements are more cylindrical in shape. These types of grinding elements are referred to as journal assemblies.

The roll wheel assemblies and the journal assemblies are located and positioned in the mill by large bracket assemblies containing pivot bearings, locating arms, and roll wheel/journal bearings. The function of these large bracket assemblies is to not only locate and position the roll wheel/journal assemblies, but to also provide a mechanism for imparting additional forces upon the roll wheel/journal assemblies and, thus, the raw coal particles in the bowl. This additional force increases the efficiency of grinding the raw coal particles and increases the grinding capacity of any vertical spindle type coal pulverizer.

The conventional means which is used in a vertical spindle coal pulverizer for imparting additional force upon the roll wheel/journal assemblies involves a complicated shaft and plunger design. The plunger is attached to a shaft, and the shaft and plunger move together axially in a canister. The shaft is located in the canister by small guide bearings. The plunger extends out of the end of the canister and imparts a force on the roll pivot bracket by making direct contact with it. The direction of the force is not axial. Consequently, there are high-maintenance requirements due to excessive bearing wear and broken shafts.

There has not heretofore been provided a coal pulverizer having the features and advantages provided by the present invention.

SUMMARY OF THE INVENTION

In accordance with the present invention there is provided improved bias means for use in vertical spindle coal pulverizers. The bias means is designed and constructed to impart additional forces upon the roll wheel or journal assemblies which, in turn, imparts additional force upon the raw coal particles in the bowl of the mill. This additional force increases the efficiency of grinding the raw coal particles and increases the grinding capacity of any vertical spindle coal pulverizer.

The improved bias means comprises an axially-loaded spring canister which preferably includes a cylindrical housing containing a coil spring and a plunger mechanism. One end of the housing is attached to the framework of the mill, and the other end of the housing is open. The coil spring biases the plunger toward the open end of the housing.

The plunger is connected to the roll wheel or journal assembly bracket by means of a linking member which transfers loadings only in an axial direction (relative to the axis of the coil spring). No radial or sidewise loadings or forces can be transmitted into the canister or mill housing by this linking mechanism.

The spring canister bias means provided by the present invention utilizes a high bearing surface area cylinder which is not attached to the plunger assembly. By using a large bearing surface area, the localized forces are reduced, thereby resulting in an increase in service life of the entire assembly.

Because the plunger is not attached to a shaft, the outside surface of the plunger itself acts as a bearing surface. This provides a much larger bearing surface than is used in a prior art canister. Also, maintenance requirements are significantly reduced because the shaft has been eliminated.

The improved bias means of this invention is externally adjustable via adjustment of the length of the linking member using common tools. This feature greatly simplifies the task of making adjustments, when desired.

The improved bias means provided by this invention is easy to install in any coal pulverizer and is inexpensive. Because the bias means is uncomplicated, few parts are required. Also, internal clearance in the canister during "no-load" situations prevents force from being transmitted to the roll pivot bracket when the mill is empty.

Other advantages of the bias means of this invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE DRAWINGS

Figure 1:
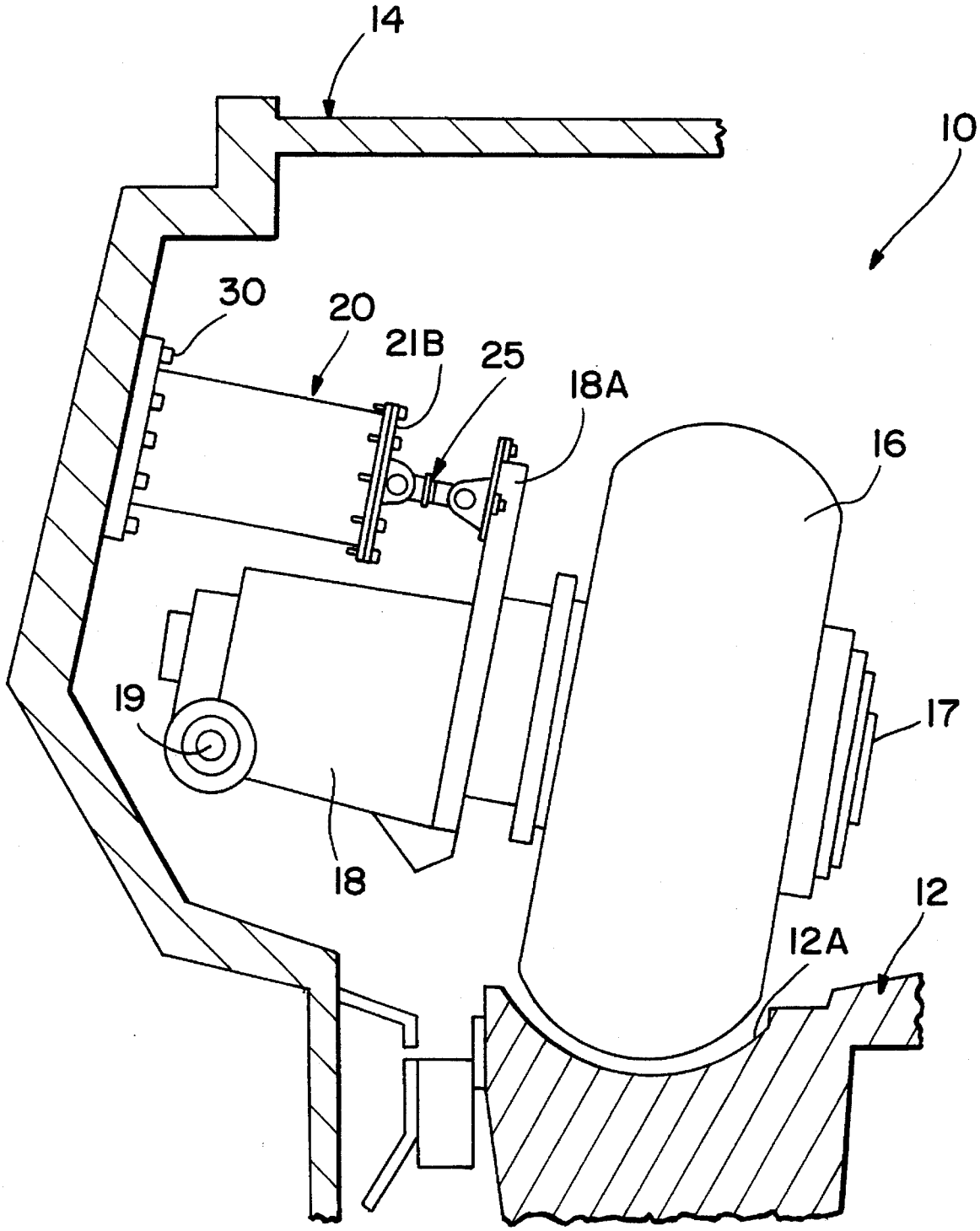
FIG. 1 is a side elevational view of one embodiment of vertical spindle coal pulverizer which includes the improved bias means of the present invention.

In the drawings there is shown a vertical spindle coal pulverizer 10 which includes a rotating bowl 12 and an outer housing or enclosure 14. A roll wheel 16 crushes coal particles in the recessed bowl area 12A. The wheel 16 rotates on a shaft 17 which is pivotably mounted by means of bracket 18 on pivot pin or shaft 19. As more coal (or larger particles of coal) is present in the recessed area 12A of the bowl, the wheel 16 is caused to pivot upwardly relative to pivot point 19.

The improved bias means 20 of the invention operates to resist the upward movement of the wheel 16 and thereby increase the force applied to the coal particles by the wheel 16. Bias means 20 comprises a cylindrical canister or barrel 21 having a base 21A which is bolted to the inner wall surface of the mill housing 14. The opposite end 21B of the canister includes an opening which is slightly smaller than the internal diameter of the main body of the canister 21.

A coil spring 22 and a plunger 23 are contained within the canister. The spring urges the plunger toward the open end of the canister. Preferably the outer diameter of the plunger is slightly smaller than the internal diameter of the canister so that the plunger can move axially within the canister with a minimum of frictional resistance. The outer end 23*a* of the plunger encounters the lip of end 21B (when the plunger is at its outermost position).

A link member 25 is positioned between the plunger 23 and an upstanding arm 18A on bracket 18. One end of link 25 includes a spherical or ball-shaped member 27 which is held in a complementary shaped mounting 28 secured to arm 18A. The opposite end of link 25 includes a spherical or ball-shaped member 26 which is held in a complementary shaped arm 24 positioned in the recessed end 23B of plunger 23. The link member preferably is adjustable in length, e.g., one portion can be in the form of a threaded shaft and the other portion includes a threaded coupling 25A. This enables the overall length of the link member to be lengthened or shortened as desired in order to accommodate any particular mill in which the system of this invention is installed. Other means for obtaining adjustable length can be used, if desired, such as use of mounting shims of desired thickness.

Figure 3:
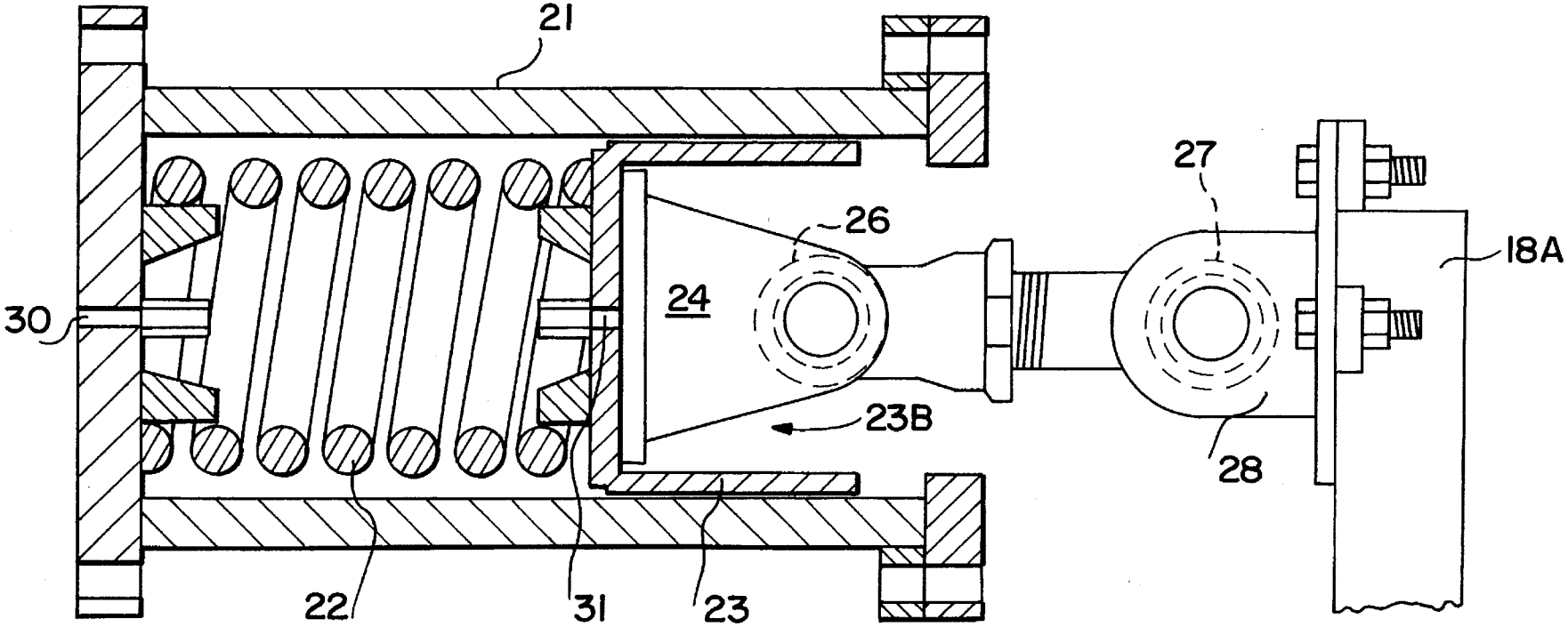
FIG. 3 is a cross-sectional view of the bias means shown in FIG. 2 when applying a force against the grinding element in a coal pulverizer.

The link member 25 is capable of transmitting force along a direct line between the joints at its opposite ends, i.e., the link member can transmit a force only along the axis of the link member. Thus, when the link member is aligned axially with the spring canister (i.e., during the normal operating condition shown in FIG. 3), no load can be transmitted to the canister except directly along its axis. This eliminates undesired loads and increases the life of the spring canister.

Other types of two-force linkages could also be used which include a ball or pin joint on each end. The linkage must be able to withstand high compressive loads and minimize bending, torsion, or sideways loads (non-axial loadings).

Figure 2:
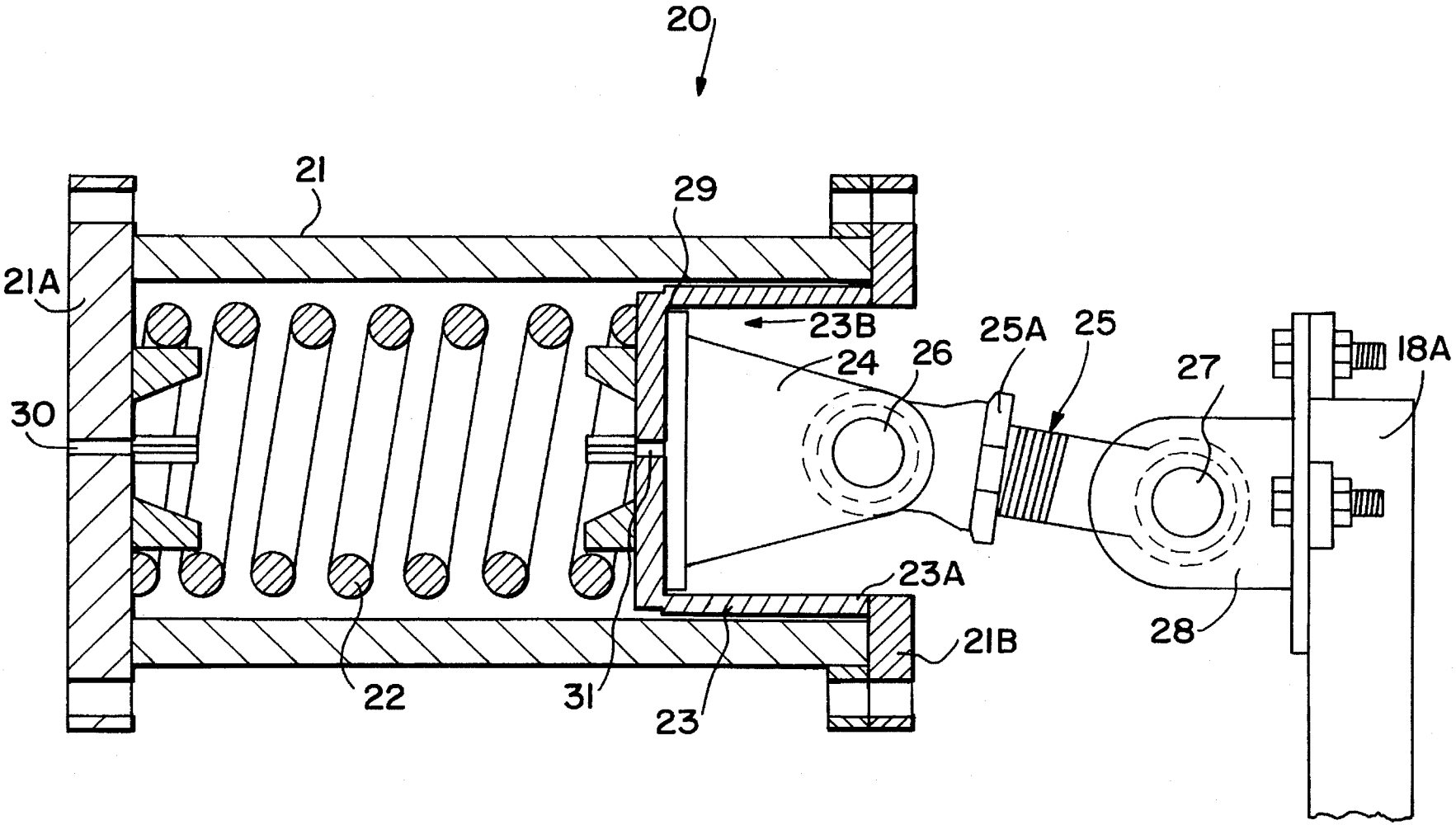
FIG. 2 is a cross-sectional view of a preferred embodiment of bias means of the invention during a "no-load" condition.

It is not necessary for arm 24 to be attached to the plunger 23. Rather, as shown in the drawings, the outer end of the plunger includes a cavity or recess 23B in which arm 24 is received. This arrangement enables the arm 24 to press against the plunger (which presses against the spring 22) when the mill is under load. However, when the mill is in a no-load condition (shown in FIG. 2) there is a slight gap 29 between the arm 24 and the plunger 23.

The base 21A of the canister 21 preferably includes an air inlet port 30, and the plunger preferably includes an air outlet port 31. In the no-load condition (FIG. 2), most of the positive air pressure entering through port 30 exits through port 31, keeping the space between arm 24 and plunger 23 clean. Under load (shown in FIG. 3) the air entering through port 30 exits around the periphery of the plunger, keeping dust out of the canister.

Other variants are possible without departing from the scope of this invention.

What is claimed is:

1. In coal pulverizer apparatus of the type including a housing with an interior surface, a vertical spindle and at least one grinding element which is rotatably mounted on a bracket assembly, wherein the shaft assembly is pivotably supported in said apparatus, wherein an axial load is imparted to said bracket assembly to pivot said assembly downwardly against a grinding bowl, the improvement comprising bias means secured to said interior surface for imparting said axial load to said bracket assembly, wherein said bias means is capable of imparting force against said bracket assembly essentially only in an axial direction; wherein said bias means comprises:

(a) a cylindrical canister member having first and second ends; wherein said first end is secured to said pulverizer apparatus; and wherein said second end is open;

(b) a spring member positioned in said canister member;

(c) a plunger member positioned in said canister member adjacent said spring member and being axially movable in said canister member; wherein said plunger member includes a recessed end; and (d) a link member having first and second ends; wherein said first end is slidably received in said recessed end of said plunger member and said second end is pivotably attached to said bracket assembly.

2. The improvement in accordance with claim 1, wherein said canister member includes an inlet port for positive air pressure, and wherein said plunger member includes an exit port for said positive air pressure.

3. The improvement in accordance with claim 1, further comprising an arm member pivotably attached to said first end of said link member; wherein said arm member is slidably received in said recessed end of said plunger member.

4. The improvement in accordance with claim 1, wherein said link member is adjustable in length.

5. The improvement in accordance with claim 1, wherein each said end of said link member includes a ball-shaped member.

* * * * *